US012780466B2

(12) United States Patent
Masuch

(10) Patent No.: US 12,780,466 B2
(45) Date of Patent: Nov. 3, 2026

(54) CABLE TIE TIGHTENING DEVICE WITH CUTTING FUNCTIONALITY

(71) Applicant: Hellermann Tyton GmbH & Co. KG, Tornesch (DE)

(72) Inventor: Moritz Masuch, Ellerbek (DE)

(73) Assignee: HellermannTyton GmbH & Co. KG, Tornesch (DE)

( * ) Notice: Subject to any disclaimer, the term of this patent is extended or adjusted under 35 U.S.C. 154(b) by 51 days.

(21) Appl. No.: 19/195,988

(22) Filed: May 1, 2025

(65) Prior Publication Data

US 2025/0340317 A1 Nov. 6, 2025

(30) Foreign Application Priority Data

May 2, 2024 (EP) ..... 24173894

(51) Int. Cl.
*B65B 13/02* (2006.01)

(52) U.S. Cl.
CPC ..... *B65B 13/027* (2013.01)

(58) Field of Classification Search
CPC ..... B65B 13/22; B65B 13/025; B65B 13/027
See application file for complete search history.

(56) References Cited

U.S. PATENT DOCUMENTS 3,752,199 A 8/1973 Fekete
6,206,053 B1 * 3/2001 Hillegonds ..... B65B 13/027 140/93.2
6,840,289 B2 * 1/2005 Hillegonds ..... B65B 27/10 140/93.2
7,124,787 B2 * 10/2006 Lueschen ..... B65B 13/027 140/93.2
8,955,556 B2 * 2/2015 Myers ..... B25B 25/00 140/93.2
12,649,598 B2 * 6/2026 Galli ..... B65B 13/027
12,649,599 B2 * 6/2026 Pontini ..... B65B 13/027
2020/0180799 A1 6/2020 Ni
2023/0060775 A1 3/2023 Hempe et al.
2023/0128208 A1 4/2023 Dyer
2024/0246711 A1 7/2024 Moyzischewitz

OTHER PUBLICATIONS

"Evo cut Launch Flyer", Apr. 2022, 2 pages.
"Extended European Search Report", EP Application No. 24173894.7, Dec 6, 2024, 7 pages.

* cited by examiner

*Primary Examiner* — Matthew Katcoff
(74) *Attorney, Agent, or Firm* — Colby Nipper PLLC

(57) ABSTRACT

Disclosed are cable tie tightening devices with cutting functionality, including a gripping unit configured to grip and pull a cable tie strap until an adjustable force limit is reached, a cutting unit configured to cut the strap, an actuator unit configured to automatically actuate gripping and cutting units, a force adjusting unit configured to adjust the adjustable force limit, where the gripping unit is attached to a piston element of the actuator unit at one side and the force adjusting unit includes a retaining element configured to retain a cylinder element of the actuator unit in a given position until the adjustable force limit is reached, while the retaining element is configured to be connected directly with the cylinder element when retaining the cylinder element in the given position, and to be disconnected from the cylinder element when the adjustable force limit is reached or exceeded.

16 Claims, 2 Drawing Sheets

CABLE TIE TIGHTENING DEVICE WITH CUTTING FUNCTIONALITY

INCORPORATION BY REFERENCE

This application claims priority to European Patent Application No. EP24173894.7, filed May 2, 2024, the disclosure of which is incorporated herein by reference.

FIELD OF THE INVENTION

The disclosure relates to a cable tie tightening device with cutting functionality, comprising a gripping unit configured to grip a cable tie strap and pull the cable tie strap until an adjustable force limit is reached, a cutting unit configured to cut the cable tie strap, an actuator unit configured to automatically actuate gripping unit and cutting unit, and a force adjusting unit configured to adjust the adjustable force limit, where the gripping unit is attached to a piston element of the actuator unit at one side of the actuator unit and the force adjusting unit comprises a retaining element configured to retain a cylinder element of the actuator unit in a given position until the adjustable force limit is reached.

BACKGROUND

Cable management is a critical aspect of modern infrastructure, ensuring organization, safety, and efficiency in various industries ranging from telecommunications to construction. Among the myriad tools facilitating this process, cable ties stand out as indispensable components for bundling and securing cables in place. The demand for efficient, ergonomic, and versatile cable tie tightening devices with cutting functionality, often called "cable-tie guns", has been steadily increasing to meet the evolving needs of professionals across diverse sectors.

The working principle of such cable-tie guns revolves around the efficient tightening and cutting of cable ties with precision and ease. By combining the functions of tensioning and trimming into a single ergonomic tool, users can achieve greater efficiency and accuracy in their cable management endeavors.

The proposed approach aims to address the challenges inherent in conventional cable tie tools by building upon the foundation of existing solutions such as the HellermannTyton Evo 7. Consequently, this patent application seeks to enhance the user experience, streamline operations, and improve overall performance in cable management tasks.

The technical task, therefore, is to provide an improved cable tie tightening device with cutting functionality.

OVERVIEW

This task is solved by the objects of the independent claims. Advantageous embodiments will be apparent from the dependent claims, the description and the figures.

One aspect relates to a cable tie tightening device with cutting functionality. Such tools are also referred to as "cable-tie guns". The device comprises a gripping unit configured to grip a cable tie strap and pull the cable tie strap until an adjustable force limit is reached, a cutting unit configured to cut the cable tie strap when the force limit is reached or exceeded, an actuator unit configured to automatically, i.e. pneumatically and/or hydraulically and/or electrically actuate the gripping unit and the cutting unit, and a force adjusting unit configured to adjust the adjustable force limit, in particular manually adjust the adjustable force limit. Therein, the gripping unit is attached to a piston element of the actuator unit at one (first/front) side of the actuator unit and the force adjusting unit comprises a retaining element configured to retain a cylinder element of the actuator unit in a given position until the adjustable force limit is reached.

Here, the retaining element is configured to be connected, i.e. engaged directly with the cylinder element when retaining the cylinder element in the given position, that is, it is configured to be connected without additional levers and/or pivots with the cylinder element. A direct engagement thus specifies an engagement with an integral part of the cylinder element. An integral part of the cylinder element or some other unit can be understood as a part that constantly has a fixed position relative to the other parts of the cylinder element or other unit, i.e. cannot be moved relative to the other parts of the cylinder element or other unit. The cylinder element as a whole, however is movable (in the axial direction) when not held in place by retaining element. In particular, the cylinder element may be movable along a longitudinal axis of the cylinder element. This longitudinal axis may align with the main extension direction of the cylinder element. Preferably, the longitudinal axis is running along the axial direction. Consequently, The retaining element is configured to be disconnected, i.e. disengaged from the cylinder element when the adjustable force limit is exceeded and/or reached. Thus, the mechanical connection/coupling established temporarily between retaining element and cylinder element may also be referred to as leverless connection/coupling. In particular, the actuator unit may be leverless, i.e. not (permanently) comprise any lever element involved in actuating gripping unit and/or cutting unit.

Thus, the actuator unit can be directly held in and released from the given position by the force adjusting unit, without any intermediate mechanical transmission. This results in less moving parts involved in the gripping/tightening/cutting of the cable tie, thus less weight, less tolerances and less space required in a housing of the device. Thus, friction is reduced and efficiency improved. As a consequence, user experience is improved by better handling of the device in particular in small spaces, better precision for the adjustable force limit, and better lifetime of the device. Furthermore, the proposed design enables a repositioning of the force adjusting unit that results in an optimized alignment of the acting forces, which further improves the precision and predictability of the device, and reduces wear.

In one embodiment, it is provided that the retaining element and/or the force adjusting unit is arranged at a second (back) side of the actuator unit opposite to the first side. In particular, the retaining element and/or the force adjusting unit can be positioned completely behind said second side in an axial direction of the device (see below for a possible definition of axial direction). Then, a plane perpendicular to the axial direction divides actuator unit on the one hand side and retaining element and/or the force adjusting unit on the other hand side. This results in a better alignment of acting forces. In comparison to known approaches, where the force adjusting unit is arranged in a handle part of the device, the proposed arrangement provides more space in the handle part. This space in the handle unit can be used for a (pneumatic or hydraulic) valve element, which simplifies the overall design and improves reparability.

In a further embodiment, it is provided that the retaining element and/or the force adjusting unit is arranged coaxially with the piston element. Thus, in the axial direction, the piston element is arranged in front of the retaining element and/or the force adjusting unit. The axial direction may be determined by a movement direction of the piston element and/or the cylinder element during intended use. Piston element and/or cylinder element may be configured to only move linearly along the axial direction during intended use. This further improves the alignment of acting forces.

In particular, the force adjusting unit may comprise a spiral spring element, the extension of which in the axial direction (and thereby a spring force of the spiral spring element) is configured to be adjusted in order to adjust the adjustable force limit. The spiral spring element may be arranged such that a central axis (preferably along the axial direction) of the spring element runs along a central axis (preferably along the axial direction) of the piston element, preferably is aligned with the central axis of the piston element. This improves the alignment of acting forces even more.

In another embodiment, it is provided that the retaining element is a hook element configured to engage with an eyelet or a pin (which may be any type of suitable protrusion) of the cylinder element when the retaining element is connected with the cylinder element in order to retain the cylinder element in the given position. The eyelet/pin may be fixed to or be part of the cylinder element such that it is only moved in the axial direction during intended use. The hook element is also configured to disengage from the cylinder element when the retaining element is disconnected from the cylinder element. Such a hook element is particularly suitable to further optimize the alignment of acting forces by placing the point of application of a restraining force.

In one embodiment, it is provided that the cylinder element has a driving element configured to actuate the cutting unit by means of a (linear) movement of the driving element along the cutting unit in a direction running along the axial direction. Thus, also the mechanical connection/coupling between cylinder element and cutting unit may be referred to as leverless connection/coupling in the above sense. This gives similar advantages of reduced number of parts and improved force alignment.

In particular, the cutting unit may comprise a lever element, one end of which is connected to a blade element configured to cut the cable tie strap, and an opposite end of which features a guiding surface. Both ends of the lever may be separated by a pivot. The ends may be opposite in the axial direction. The guiding surface translates a movement of the driving element in the axial direction into a movement of the lever element in a radial direction running transverse to the axial direction. The blade element may be configured to cut the cable tie strap by a linear (upwards) movement in the radial direction, as known from the prior art. This design allows a slim shape of the device at its front side where the gripping unit grips the cable tie strap while maintaining a high level of precision.

In a further embodiment, it is provided that the force adjusting unit comprises a lever element, one end of which is comprising or connected to the retaining element, and an opposite end (as of in the axial direction) of which is connected to a further element of the force adjusting unit, in particular the spiral spring element. This allows a particularly precise alignment of force adjusting unit/spiral spring element with the piston element, leading to a further improvement of the alignment of acting forces with the described advantages.

In another embodiment, it is provided that gripping unit, cutting unit, actuator unit configured and force adjusting unit are at least partially (i.e. partially or completely) arranged in a housing unit forming a handle part. Therein said gripping unit, cutting unit, actuator unit and force adjusting unit are arranged at the same side of the handle part, in particular at the same (upper) side of a trigger element configured to trigger the actuator unit. The trigger element may be configured to open a pneumatic valve element arranged in the handle part, for instance. This arrangement particularly improves ergonomics and thus leads to a better alignment of acting forces when the device is used in situ.

Another aspect relates to a method for tightening and cutting a cable tie. This method comprises the method steps of gripping a cable tie strap with a gripping unit, of pulling the gripped cable tie strap until an adjustable force limit is reached, by moving a piston element of an actuator unit which is attached to the gripping unit relative to a cylinder element of the actuator unit, of disengaging a retaining element of a force adjusting unit (directly) from the cylinder element, thereby allowing an axial movement of the cylinder element relative to a housing, and of actuating a lever element of the cutting unit, one end of which is connected to a blade element, by a direct interaction of the axially moving cylinder element with an opposite end of the lever element.

Advantages and advantageous embodiments of the latter aspects correspond to the advantages and advantageous embodiments described for the former aspect, and vice versa.

The features and combinations of features described, including those of the general introduction, as well as the features and combinations of features disclosed in the figure description or in the figures alone, may be used not only alone or in the combination described, but also with other features or without some of the features disclosed, without departing from the scope of the invention. Consequently, embodiments are also part of the invention which are not explicitly shown and described in the figures, but which can be produced by separately combining the individual features disclosed in the figures. Therefore, embodiments and combinations of features which do not comprise all features of an originally formulated independent claim are also to be considered disclosed. Furthermore, embodiments and combinations of features are to be regarded as disclosed which deviate from or go beyond the combinations of features described in the dependencies of the claims.

In the context of the present disclosure, "transverse/dextral" may be understood as "at least substantially vertical/parallel", i.e. "vertical/parallel" or "substantially vertical/parallel", i.e. vertical/parallel except for a predetermined deviation. The predetermined deviation can, for example, be at most 15°, preferably at most 5°, particularly preferably at most 3°. Accordingly, "oppositely oriented" may be understood in the context of the present disclosure as "at least substantially oppositely oriented" i.e. "at least substantially anti-parallel oriented". The limitation "substantially" may also refer to a percentage predetermined maximum permissible deviation, for example at most 15%, preferably at most 5%, particularly preferably at most 3%. The terms "up", "down", "front", and "back" relate to the position of the device in a standard use case, i.e. a user holding the device in front of him similar to a pistol with a handle part pointing towards the ground. Then the back side of the device is oriented towards the user, and "down" indicates a direction to the ground.

BRIEF DESCRIPTION OF THE DRAWINGS

Exemplary embodiments are described in more detail below with reference to schematic drawings. Therein

In the figures, the same or functionally identical features are provided with the same reference signs.

DETAILED DESCRIPTION

Figure 1:
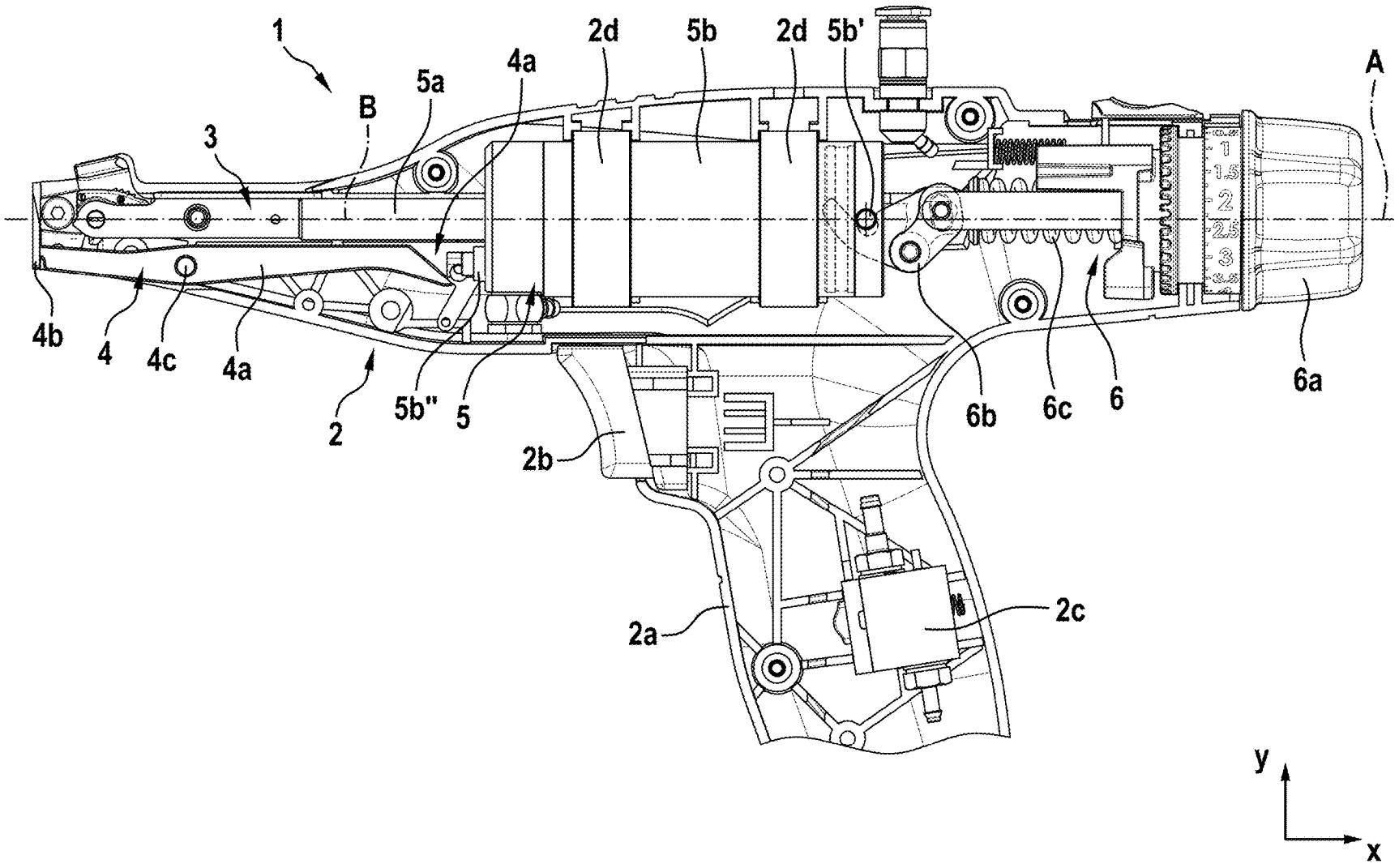
FIG. 1 shows an exemplary embodiment of a cable tie tightening device with cutting functionality in a first state.
Figure 2:
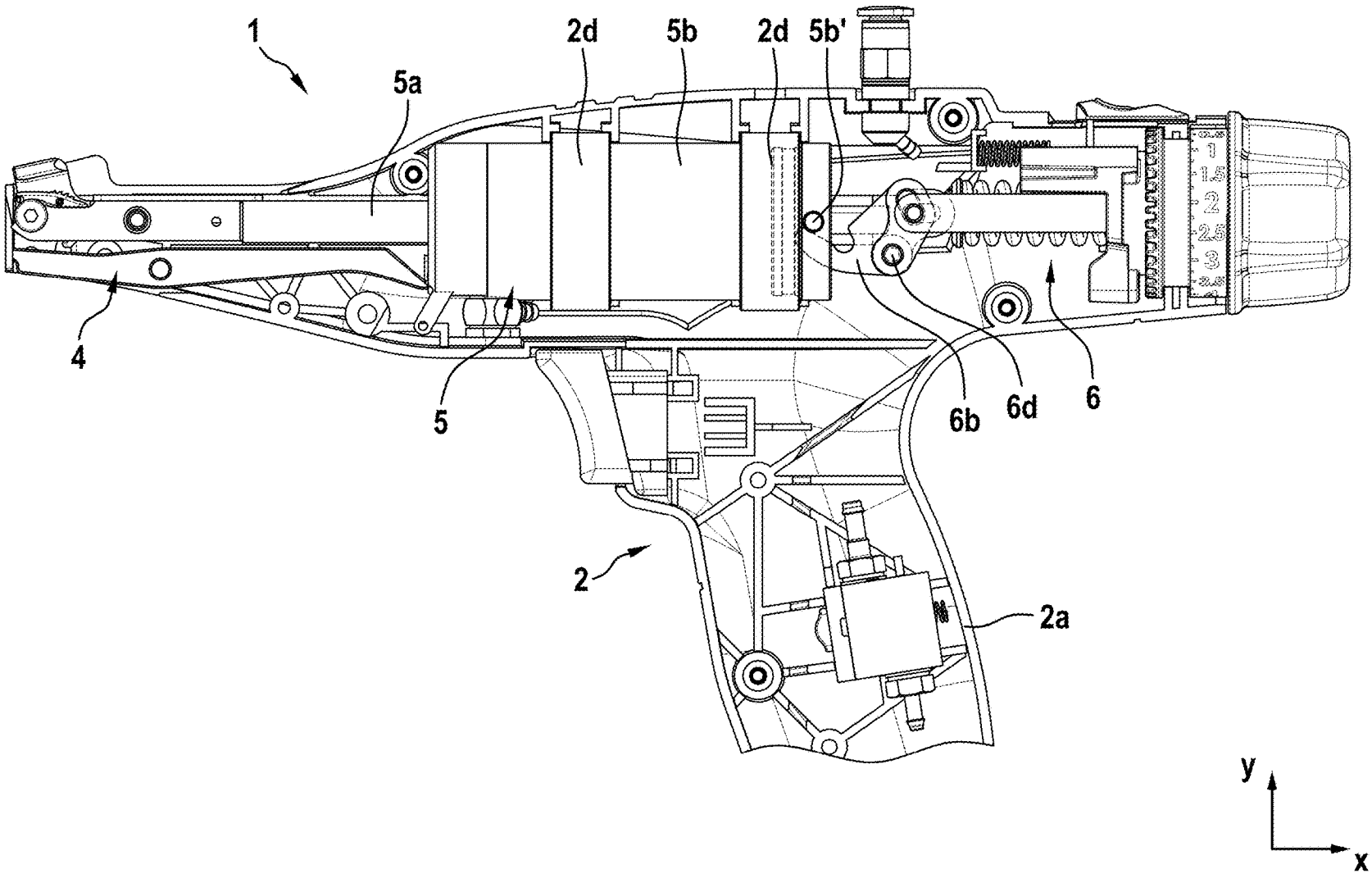
FIG. 2 shows the exemplary embodiment of FIG. 1 in a second state.

The figures show an exemplary embodiment of a cable tie tightening device 1 in a side view with one part of the housing unit 2 and some further parts like pneumatic hoses removed for better clarity. FIG. 1 shows the cable tie tightening device 1 in a first state which corresponds to an initial configuration where the cable tie tightening device 1 is about to be used. FIG. 2 shows the cable tie tightening device 1 in a second state which corresponds to an final configuration where the cable tie tightening device 1 has been used and just cut the cable tie strap. After the second state, the cable tie tightening device 1 can automatically reconfigure into the first state.

The cable tie tightening device 1 with cutting functionality comprises a gripping unit 3, a cutting unit 4, an actuator unit 5, and a force adjusting unit 6 that are at least partially arranged in the housing unit 2 (the actuator unit 5 being arranged completely in the housing unit 2 here). The housing unit 2 comprises a handle part 2*a* and a trigger element 2*b* in the present example. The trigger element 2*b* is configured to trigger the actuator unit 5.

The gripping unit 3 is configured to grip a cable tie strap (not shown) and to pull the cable tie strap until an adjustable force limit is reached (towards the actuator unit 5, in positive x-direction here). The cutting unit 4 is configured to cut the cable tie strap when the force limit is reached/exceeded. The actuator unit 5 is configured to automatically actuate gripping unit 3 and cutting unit 4, here to pneumatically actuate the other units 3, 4. The force adjusting unit 6 configured to adjust the adjustable force limit. This can be implemented by means of an adjustment wheel 6*a*, for instance. In the present example, said units 3, 4, 5, 6 are arranged at the same side of the handle part 2*a*, i.e. the upper side which is the side above the trigger element 2*b* here (in positive y-direction). Since this arrangement makes space in the handle part 2*a*, a pneumatic valve element 2*c* may be placed there. This allows a slimmer design of the upper side of the housing unit 2 and thereby the cable tie tightening device 1.

The gripping unit 3 is attached to a piston element 5*a* of the actuator unit 5 at one side (the front side, oriented in the negative x-direction here) of the actuator unit 5. The force adjusting unit 6 comprises a retaining element 6*b* configured to retain a cylinder element 5*b* of the actuator unit 5 in a given position until the adjustable force limit is reached. This given position is the position of the cylinder element 5*b* in the first state shown in FIG. 1. As the retaining element 6*b* is configured to be connected directly with the cylinder element 5*b* when retaining the cylinder element 5*b* in the given position, it engages an integral part of the cylinder element 5*b*, here a pin 5*b*'. An integral part of a unit can be understood as a part that is fixed relative to the other parts of the unit, i.e. cannot be moved relative to the other parts of the unit. The retaining element 6*b* is also configured to be disconnected from the cylinder element 5*b* when the adjustable force limit is reached or exceeded (see FIG. 2). To this end, it is formed as a hook element here. Consequently, the cylinder element 5*b* itself is movable in the axial direction (when not held in place by retaining element 6*b*). A longitudinal axis of the cylinder element 5*b*, which may align with its main extension direction, is running along the axial direction in this example (x-direction here). This is implemented, in the current example, by one or more holders 2*d* of the housing unit 2 that hold the cylinder element 5*b* in place but allow gliding of the cylinder element 5*b* back and forth (x-direction here) relative to the holders 2*d*, i.e. housing unit 2.

In the present example, the retaining element 6*b* and the force adjusting unit 6 are arranged at a second side (the back side, oriented in positive x-direction here) of the actuator unit 5 opposite to the first side. This is done in such a way here that the retaining element 6*b* and the force adjusting unit 6 are arranged coaxially with the piston element 5*a*. In particular, the force adjusting unit 6 comprises a spiral spring element 6*c*, the extension of which in an axial direction (x-direction here), and thereby a spring force of which, is configured to be adjusted to adjust the adjustable force limit. This spiral spring element 6*c* is arranged such that a central axis A (along the axial direction) of the spring element 6 is aligned with the central axis B of the piston element 5*a* here (which is also the central axis of the cylinder element 5*b*). Advantageously, the pin 5*b*, i.e. the integral part of the cylinder element 5*b* the retaining element 6*b* interacts (engages/disengages) with is also aligned with the central axes A, B.

Here, the cylinder element 5*b* has a driving element 5*b*", here formed as another integral part. The driving element 5*b*" is configured to actuate the cutting unit 4 by means of a movement of the driving element 5*b*" along the cutting unit 4, here along a guiding surface 4*a*' of a lever element 4*a*, in a direction running along the axial direction (negative x-direction here). The guiding surface 4*a*' is configured to translate a movement of the driving element 5*b*" in the axial direction into a movement of the lever element 4*a* in a radial direction (here y-direction). In the present case, due to pivot 4*c*, a (front) end of the lever element 4*a* with blade element 4*b* moves up (here positive y-direction) when the (back) end of the lever element 4*a* with the guiding surface 4*a*' is driven down (here negative y-direction) when the cylinder element 5*b* with the driving element 5*b*" is moving forward (in the negative x-direction).

During intended use, the shown exemplary cable tie tightening device 1 can be used to grip a cable tie strap with the gripping unit 3 and pull it backwards (in the positive x-direction). As long as a pulling force exerted onto the cable tie strap in this process (by the gripping unit 3), the piston element 5*a* will move (backwards, in the positive x-direction) relative to the associated cylinder element 5*b*. The cylinder element 5*b* will stay in the position shown in FIG. 1 in spite of being itself movable in the axial direction (here x-direction), since retaining element 6*b* is engaged with the cylinder element 5*b*, i.e. with pin 5*b*'. Thus, the pulling force acts on the retaining element 6*b*, i.e. the force adjusting unit 6.

When the pulling force reaches/exceeds the set/adjusted force limit, the retaining element 6*b* disengages the cylinder element 5*b*, here pin 5*b*', and allows the cylinder element 5*b* to move frontwards (negative x-direction here), with the driving element 5*b*" actuating the cutting unit 4. The position finally reached is shown in FIG. 2. Here, blade element 4*b* is moved upwards and has cut the cable tie strap. As compared to FIG. 1, the cylinder element 5*b* is positioned closer to the front of the cable tie tightening device 1 (end part of cable tie tightening device 1 in negative x-direction). The retaining element 6*b* is disengaged from the cylinder element 5*b* by being rotated around pivot 6*d*. This rotation is prevented by the spiral spring element 6*c* for pulling forces below/up to the adjusted force limit.

What is claimed is:

1. A cable tie tightening device with cutting functionality, comprising:

a gripping unit configured to grip a cable tie strap and pull the cable tie strap until an adjustable force limit is reached;

a cutting unit configured to cut the cable tie strap;

an actuator unit configured to automatically actuate the gripping unit and the cutting unit, the gripping unit attached to a piston element of the actuator unit at one side of the actuator unit; and a force adjusting unit configured to adjust the adjustable force limit, the force adjusting unit comprising a retaining element configured to retain a cylinder element of the actuator unit in a given position until the adjustable force limit is reached, the retaining element configured to be connected directly with the cylinder element when retaining the cylinder element in the given position, and to be disconnected from the cylinder element when the adjustable force limit is reached or exceeded.

2. The cable tie tightening device according to claim 1, wherein at least one of the retaining element or the force adjusting unit is arranged at a second side of the actuator unit opposite to a first side.

3. The cable tie tightening device according to claim 1, wherein at least one of the retaining element or the force adjusting unit is arranged coaxially with the piston element.

4. The cable tie tightening device according to claim 1, wherein the force adjusting unit comprises a spiral spring element, the extension of which in an axial direction, and thereby a spring force of which, is configured to be adjusted to adjust the adjustable force limit, which is arranged such that a central axis of the spiral spring element runs along a central axis of the piston element.

5. The cable tie tightening device according to claim 4, wherein the central axis of the spiral spring element is aligned with the central axis of the piston element.

6. The cable tie tightening device according to claim 1, wherein the retaining element is a hook element configured to engage with an integral part of the cylinder element and configured to disengage from the integral part of the cylinder element when the retaining element is disconnected from the cylinder element.

7. The cable tie tightening device according to claim 6, wherein the hook element is configured to engage with an eyelet or a pin of the cylinder element when the retaining element is connected with the cylinder element to retain the cylinder element in the given position.

8. The cable tie tightening device according to claim 4, wherein the cylinder element has a driving element configured to actuate the cutting unit through a movement of the driving element along the cutting unit in a direction running along the axial direction.

9. The cable tie tightening device according to claim 8, wherein the cutting unit comprises a lever element, one end of which is connected to a blade element configured to cut the cable tie strap, and an opposite end of which features a guiding surface which is configured to translate a movement of the driving element in the axial direction into a movement of the lever element in a radial direction running transverse to the axial direction.

10. The cable tie tightening device according to claim 1, wherein the force adjusting unit comprises a lever element, one end of which is comprising the retaining element, and an opposite end of which is connected to a further element of the force adjusting unit.

11. The cable tie tightening device according to claim 10, wherein the force adjusting unit comprises a spiral spring element and the opposite end of the lever element is connected to the spiral spring element.

12. The cable tie tightening device according to claim 1, wherein the force adjusting unit comprises a lever element, one end of which is connected to the retaining element, and an opposite end of which is connected to a further element of the force adjusting unit.

13. The cable tie tightening device according to claim 12, wherein the force adjusting unit comprises a spiral spring element and the opposite end of the lever element is connected to the spiral spring element.

14. The cable tie tightening device according to claim 1, wherein the gripping unit, cutting unit, actuator unit, and force adjusting unit are at least partially arranged in a housing unit forming a handle part, wherein said gripping unit, cutting unit, actuator unit, and force adjusting unit are arranged at the same side of the handle part.

15. The cable tie tightening device according to claim 14, wherein said gripping unit, cutting unit, actuator unit, and force adjusting unit are arranged at the same side of a trigger element configured to trigger the actuator unit.

16. A method for tightening and cutting a cable tie, comprising:

gripping a cable tie strap with a gripping unit;

pulling the gripped cable tie strap until an adjustable force limit is reached, by moving a piston element of an actuator unit which is attached to the gripping unit relative to a cylinder element of the actuator unit;

disengaging a retaining element of a force adjusting unit from an integral part of the cylinder element, thereby allowing an axial movement of the cylinder element relative to a housing unit; and actuating a lever element of a cutting unit, one end of which is connected to a blade element, by an interaction of the axially moving cylinder element with an opposite end of the lever element.

* * * * *